US005851078A

United States Patent [19]

Bow et al.

[11] Patent Number: 5,851,078

[45] Date of Patent: Dec. 22, 1998

[54] MECHANISM FOR EXTENDING AND RETRACTING A COSMETIC POMADE

[75] Inventors: Clark F. Bow, Dandridge; Robert J. Epley, Knoxville, both of Tenn.

[73] Assignee: Anchor Advanced Products, Inc., Knoxville, Tenn.

[21] Appl. No.: 767,943

[22] Filed: Dec. 17, 1996

[51] Int. Cl.[6] ..... A45D 40/04; A45D 40/12

[52] U.S. Cl. ..... 401/78; 401/80

[58] Field of Search ..... 401/78, 80

[56] References Cited

U.S. PATENT DOCUMENTS

| | | |
|---|---|---|
| 1,480,449 | 1/1924 | Kendall . |
| 1,483,220 | 2/1924 | Foster . |
| 1,504,216 | 8/1924 | Coryell . |
| 1,547,814 | 7/1925 | Hyde . |
| 1,565,142 | 12/1925 | Coryell . |
| 1,568,178 | 1/1926 | Noble . |
| 1,632,764 | 6/1927 | Nobel . |
| 1,695,407 | 12/1928 | Anderson . |
| 1,781,852 | 11/1930 | Lyhne . |
| 1,782,365 | 11/1930 | Nelson et al. . |
| 1,835,879 | 12/1931 | Kendall . |
| 1,849,531 | 3/1932 | Lyhne . |
| 1,899,748 | 2/1933 | Cornell, Jr. . |
| 1,909,988 | 5/1933 | Vogel . |
| 1,974,418 | 9/1934 | Cornell, Jr. . |
| 2,019,680 | 11/1935 | Kasdan et al. . |
| 2,057,502 | 10/1936 | Peterson . |
| 2,079,131 | 5/1937 | Reichenbach et al. . |
| 2,089,832 | 8/1937 | Kasdan et al. . |
| 2,159,872 | 5/1939 | Younghusband . |
| 2,222,415 | 11/1940 | Landwehr . |
| 2,250,876 | 7/1941 | Mitchell . |
| 2,482,368 | 9/1949 | Reichenbach . |
| 2,491,723 | 12/1949 | Gelardin . |
| 2,497,950 | 2/1950 | Lohr et al. . |
| 2,595,635 | 5/1952 | Braselton . |
| 2,766,876 | 10/1956 | Hopgood . |
| 2,815,123 | 12/1957 | Safianoff . |
| 3,091,329 | 5/1963 | Levine . |
| 3,335,853 | 8/1967 | Geisel . |
| 3,346,103 | 10/1967 | Swenson . |
| 3,653,779 | 4/1972 | Schwartzman . |
| 3,758,218 | 9/1973 | Pfrommer et al. . |
| 3,913,595 | 10/1975 | Grisel . |
| 4,108,558 | 8/1978 | Radice et al. . |
| 4,166,474 | 9/1979 | McArdle et al. . |
| 4,166,707 | 9/1979 | Zawacki, Jr. et al. . |
| 4,417,827 | 11/1983 | Kasai et al. . |
| 4,615,632 | 10/1986 | Iwamoto et al. . |
| 4,770,556 | 9/1988 | Ackermann et al. . |
| 4,804,286 | 2/1989 | Jarrett et al. . |
| 4,966,479 | 10/1990 | Idec et al. . |
| 5,033,893 | 7/1991 | Hainaut . |
| 5,096,318 | 3/1992 | Susini et al. ..... 40/12 |
| 5,102,249 | 4/1992 | Holloway et al. . |
| 5,172,993 | 12/1992 | Ackermann et al. . |
| 5,174,673 | 12/1992 | Gruner . |
| 5,186,560 | 2/1993 | Holloway . |
| 5,234,275 | 8/1993 | Gueret . |
| 5,302,042 | 4/1994 | Ackermann . |

FOREIGN PATENT DOCUMENTS

| | | |
|---|---|---|
| 2 670 998 | 7/1992 | France . |
| 63-166111 | 10/1988 | Japan . |

*Primary Examiner*—Steven A. Bratlie
*Attorney, Agent, or Firm*—Godfrey & Kahn, S.C.

[57] ABSTRACT

A mechanism for extending and retracting a cosmetic pomade that has a base with a raised portion and a shelf, at least one aperture positioned near the shelf, and a middle portion having a plurality of slots. The mechanism also includes a cup for holding the cosmetic pomade. The cup is positioned within, and has protrusions for engaging the slots of, the base. A spiral guide member is positioned coaxially with the base. The spiral guide member has a helically-shaped track and a substantially smooth portion or extension. An insert is positioned within the base. The insert has at least one radially projecting tab that extends through the at least one aperture positioned near the shelf of the base to contact the substantially smooth extension of the spiral guide member. Preferably, the insert includes two or more tabs and each one of them is made from a flexible material having a relatively low coefficient of friction relative to the material of the spiral guide member.

17 Claims, 4 Drawing Sheets

MECHANISM FOR EXTENDING AND RETRACTING A COSMETIC POMADE

FIELD OF THE INVENTION

The present invention relates generally to cosmetics containers and, more particularly, to dispensers of cosmetic pomades

BACKGROUND OF THE INVENTION

Millions of lipsticks are sold every year. Most of these lipsticks are sold in packages with cam type mechanisms for extending and retracting the cosmetic pomade. The working parts of these packages generally consist of three components: 1) a "sleeve" or "cartridge," hereinafter referred to as a "base"; 2) a "cup" which holds the pomade and is positioned within the base; and 3) a "cam" or "spiral" having a helical groove or slot to drive the pomade up and down. As generally recognized within the industry, it is desirable that the mechanism have a smooth tactile feel when operated. Cosmetics manufacturers believe that a mechanism with a quality feel increases the perceived value of their products.

Due to the manner in which lipstick mechanisms are assembled and the processes that are used to produce the components comprising them, allowances must be made for clearance between the working parts to ensure that the mechanisms don't bind or lock-up. The clearances between the parts, although very small, can be felt by the user as axial or radial "play," and mechanisms designed to prevent binding or locking up usually suffer from unacceptable amounts of play in the cup, spiral, or both. Thus, many manufacturers place lubricants within the mechanisms to fill the clearances and give the mechanisms a smooth feel when operated and to minimize the amount of noticeable play.

Traditionally, lipstick-type cosmetics have been premolded into a stick shape as a "bullet" or "pomade," chilled, and then, while chilled, inserted by hand or machine into the cup of the lipstick mechanism. In newer, increasingly-used processes, molten cosmetic is poured or injected directly into the cup of the mechanism. It is then frozen in place to form the pomade. The low temperatures used in the newer processes can stiffen mechanism lubricants and, therefore, make it very difficult to fill the mechanisms with them. Further, while using a lubricant helps reduce play, the lubricant will often leak to the outer surface of the mechanism, diminishing its appearance.

There have been some attempts to develop lipstick mechanisms having an improved feel. For example, U.S. Pat. No. 5,186,560, issued to Holloway, discloses an inner body flex tab cosmetic dispenser having an inner body, a cam sleeve, and an elevator cup. Two tabs are formed with and attached to the lower end of the inner body. The tabs extend radially outward and engage the inner surface of the cam sleeve. The tabs provide a frictional braking effect against the cam sleeve to give the desired drag and constant swivel torque. While useful, this device suffers from at least two drawbacks. First, the flex tabs are not sufficiently flexible, as their ability to flex is dependent on the flexibility of the inner body to which they are directly attached. Second, the high coefficient of friction tabs are not needed to create drag, because appropriate drag can be achieved if the other parts of the mechanism are machined, molded, or otherwise constructed precisely.

Accordingly, it would be desirable to have a mechanism for extending and retracting a cosmetic pomade that overcomes the disadvantages of the prior art, functions smoothly, without play, and which can do so with little or no lubricant.

OBJECTS AND SUMMARY OF THE INVENTION

Therefore, it is an object of the present invention to provide a mechanism for extending and retracting a cosmetic pomade that functions smoothly.

A further object of the present invention is to provide a mechanism for extending and retracting a cosmetic pomade that displays no perceptible play and achieves this level of operation without the use of lubricants.

These and other objects are achieved in a mechanism for extending and retracting a cosmetic pomade that has a base, a raised portion with a shelf, at least one aperture positioned near the shelf, and a middle portion having a plurality of slots. The mechanism also includes a cup for holding the cosmetic pomade. The cup is positioned within and has means for engaging the slots of the base. A spiral guide member is positioned coaxially with the base. The spiral guide member has two grooves, and a substantially smooth portion or extension.

An insert is positioned within the base. The insert has at least one radially projecting tab for engaging the spiral guide member. The tab extends through the aperture that is positioned near the shelf of the base to contact the substantially smooth extension of the spiral guide member. Preferably, the insert includes two or more tabs, each one of which is made from a material having a relatively low coefficient of friction with respect to the material of the spiral guide member.

The improved performance of the present invention is due, in large part, to the use of the insert. The insert locates the spiral guide member and the base in relation to one another while creating small, defined, low friction points of contact. The insert is pliable or flexible enough to conform to the diameter of the bottom of the spiral guide member so that even with the size variances that can be expected in the parts, the insert will always be in intimate contact with the extension of the spiral guide member. The insert centers the base within the spiral guide member reducing or eliminating rubbing contact between the two pieces. At the same time, because the insert is in intimate contact with the spiral guide member, it creates a damping effect on any linear play that exists within the mechanism. Since the insert is made of a material that offers a low coefficient of friction against the material of the spiral guide member and bears against the smooth extension, the "feel" during operation of the mechanism remains smooth and easy.

By replacing the more random areas of contact between the working parts of a typical mechanism with a few defined areas of relatively low friction, the overall friction typically encountered within a traditional lipstick mechanism can be reduced. Thus, the user is presented with a lipstick mechanism that has very little detectable play between the components and one that rotates more evenly, without using lubricants.

These and other objects, features, and advantages of the present invention will become more apparent by reference to the detailed description of the invention and the accompanying drawings.

DETAILED DESCRIPTION OF THE INVENTION

Figures 1, 1A, 2:
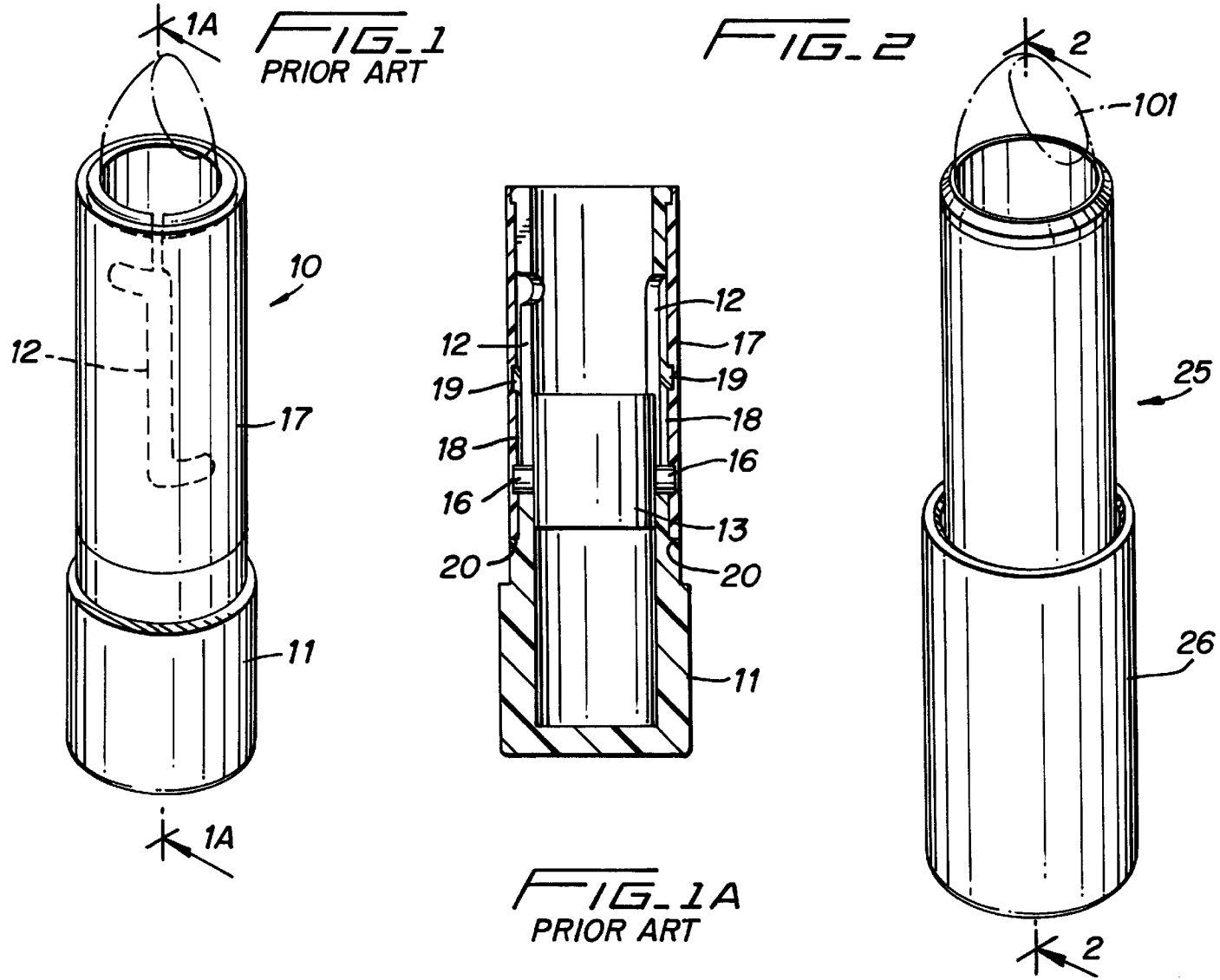
FIG. 1A PRIOR ART
FIG. 1 PRIOR ART
FIG. 1 is a perspective view of a prior-art mechanism for extending and retracting a cosmetic pomade.
FIG. 1A is a cross-sectional view of the prior-art mechanism for extending and retracting a cosmetic pomade taken along the line 1A—1A of FIG. 1.
FIG. 2 is a perspective view of a mechanism for extending and retracting a cosmetic pomade made in accordance with the teachings of the present invention.

A prior-art mechanism 10 for extending and retracting a cosmetic pomade (a "lipstick mechanism") is shown in FIGS. 1 and 1A. The mechanism 10 includes a base 11 with two tracks 12. A cup 13 for holding a cosmetic pomade rides in the tracks by means of two protrusions 16. Surrounding the base 11 is a spiral guide member 17 having an inner surface 18 with two grooves 19. The spiral guide member 17 sits on a shelf 20 and rotates with respect to the base 11. The protrusions 16 extend into the grooves 19 and, as the spiral guide member is rotated, the cup is moved up and down, by the rotation of the spiral guide member grooves. The cup 13 is guided by the tracks 12 so as to move in a linear fashion.

A mechanism 25 made according to the teachings of the present invention is shown in FIG. 2. As best seen by reference to FIG. 3, the mechanism 25 includes an outer base or holder 26. The holder 26 has a first closed end 28, a second open end 29, and a cylindrically-shaped interior portion 31. Preferably, the holder 26 has a height of about 1.125" and an inner diameter at the open second end 29 of about 0.683". The holder 26 is used for purposes of enhancing the appearance of the mechanism 25 by concealing some of its operational components. Therefore, it is an optional part of the mechanism 25.

The mechanism 25 also includes an inner base 34 (hereinafter "base 34") that is designed to sit within the holder 26 (See FIG. 4.) The base 34 has a first end 35, a second end 36, a raised portion 37 with a shelf 38, and a middle portion 39. The second end 36 includes two recesses 41 and two oppositely facing windows or apertures 43 positioned near the shelf 38. The base 34 also includes two oppositely positioned tracks or slots 46 and 47, which are positioned on the middle portion 39. The first slot 46 has a terminal aperture 48. Each slot has a width of about 0.130" and is about 1.3" long. Preferably, the base has a height of about 2.5", an inner diameter at the first end 36 of about 0.5", and is made out of a polymeric material, as are the rest of the components of the mechanism 25 that are described below.

Figure 8:
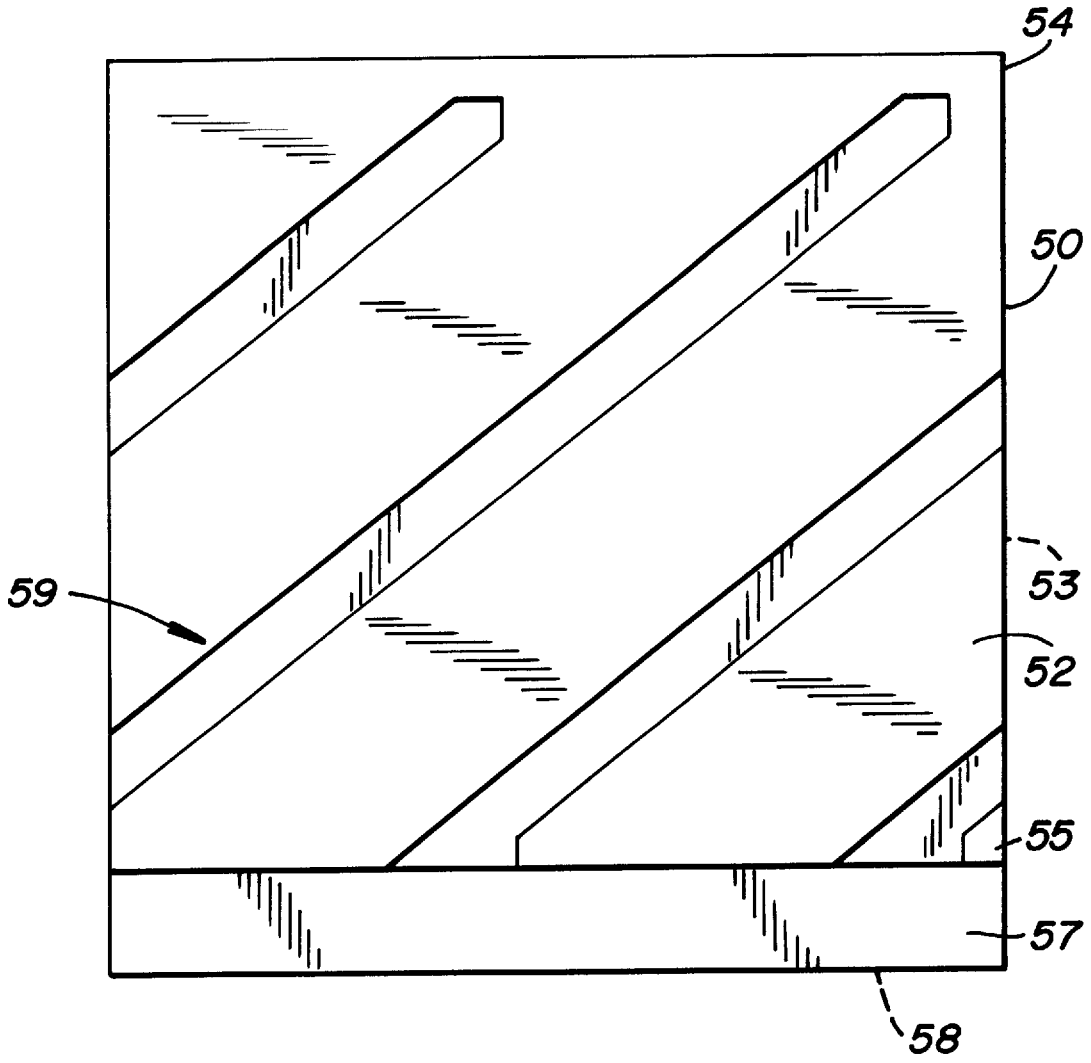
FIG. 8 is a orthogonal projection, plan view of the interior of a spiral guide member used in the mechanism of the present invention.

A spiral guide member 50 is positioned in close proximity, and in coaxial alignment with, the base 34. The spiral guide member 50 fits over the base 34 in a snap-fit manner and is formed in a generally cylindrical shape in an injection molding process. (For illustrative purposes, the spiral guide member 50 is shown in a flattened or orthogonal projection view in FIG. 8.) The spiral guide member 50 has an inner surface 52, a substantially smooth, outer surface 53, a first end 54, and a second end 55. The inner surface 53 has a helically-shaped track 59 for engaging the protrusions of a cosmetic-holding cup, which is discussed below. Preferably, each track 59 is about 0.130" wide and the spiral guide member 50 is made from acrylonitrile butadiene styrene or "ABS."

The spiral guide member 50 has a substantially smooth portion or extension 57 with an edge 58. The extension 57 is positioned adjacent to the second end 55. In one embodiment of the invention, the spiral guide member 50 has an inner diameter at the extension 57 of about 0.62". When the mechanism 25 is assembled, the edge 58 is positioned above and in close proximity to the shelf 38 of the base 34. So positioned, the extension 57 will contact an insert 70 (discussed further below).

Figure 3:
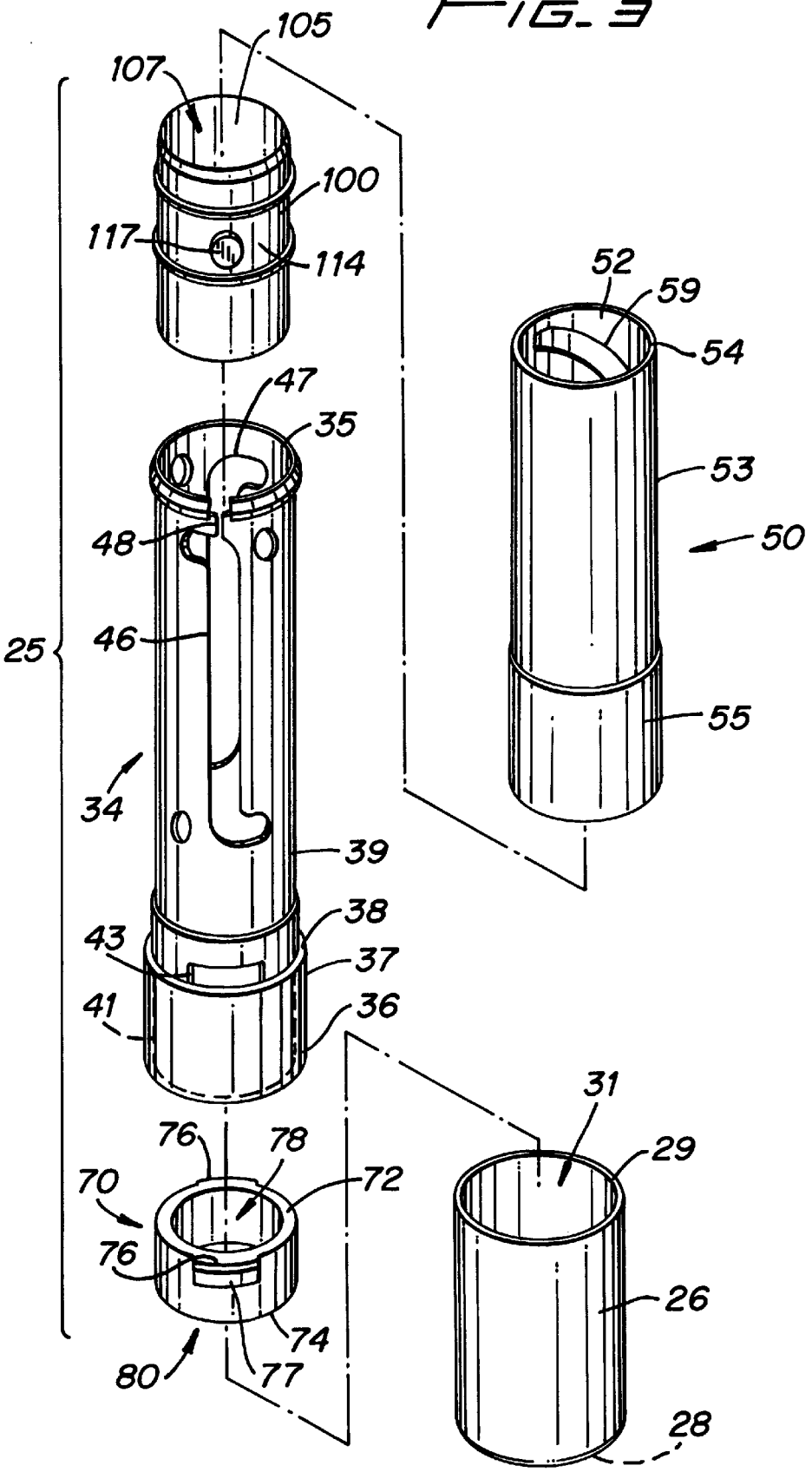
FIG. 3 is an exploded, perspective view of the mechanism for extending and retracting a cosmetic pomade shown in FIG. 2.
Figure 4:
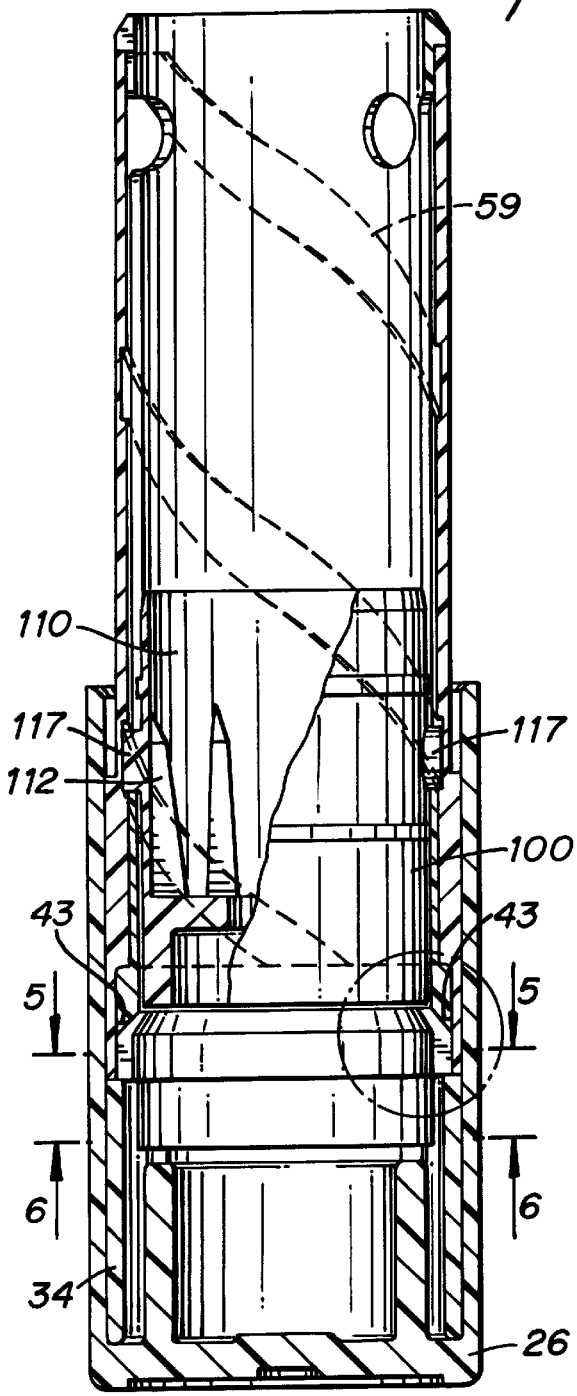
FIG. 4 is a cross-sectional view of the mechanism taken along the line 2—2 of FIG. 2.
Figure 5:
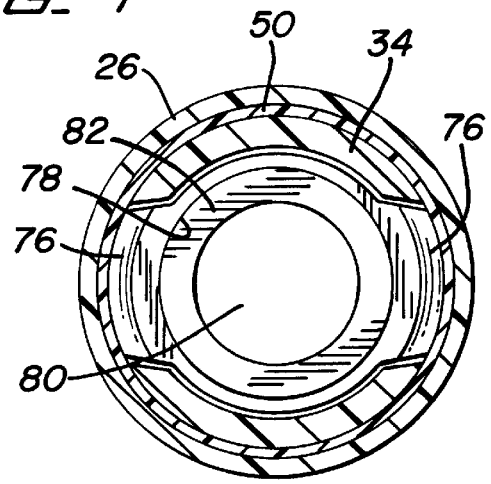
FIG. 5 is a cross-sectional view of the mechanism taken along the line 5—5 of FIG. 4.
Figure 6:
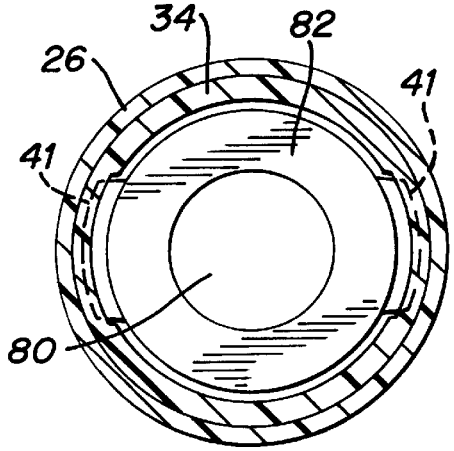
FIG. 6 is a cross-sectional view of the mechanism taken along the line 6—6 of FIG. 4.
Figure 7:
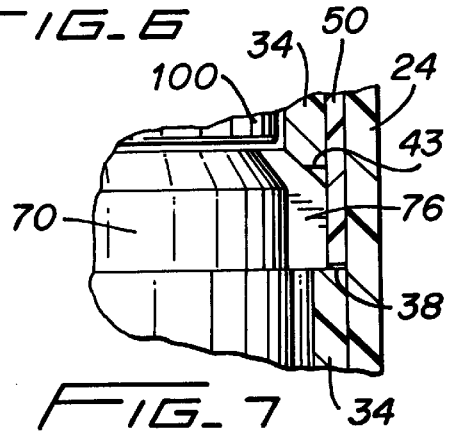
FIG. 7 is a partial, enlarged, cross-sectional view of the mechanism as shown in FIG. 4.

The insert 70 is positioned within the base 34 (FIGS. 3 and 4). The insert 70 has a flexible, main body 71, a first end 72, a second end 74, and two radially extending tabs 76, each having a contact surface 77. The insert 70 is generally cylindrical in shape and also has a top opening 78 and a bottom opening 79. Preferably, the bottom opening 79 is smaller in diameter than the top opening 78 and is defined by a ledge 82 (FIG. 6). Preferably, the insert 70 is made out of a flexible material such as polyethylene and has a diametral dimension from contact surface to contact surface of about 0.63". Preferably, the material has a hardness of about 40 to 50 durometer as measured on the D scale. It was found that the flexural modulus of the insert should be approximately 20 KSI to 40 KSI (1 KSI=1000 lbs/in$^2$), otherwise performance of the mechanism 25 is reduced. Similarly, the coefficient of friction between the material of the insert and the material of the spiral guide member 50 should be less than 0.1 in order to achieve proper performance. While it is preferred that the insert be made from a low friction material, it is possible that the tabs 76 alone be made from such a material.

The insert 70 is slid into the base 34 by aligning the tabs 76 to match the recesses 41. The insert is pushed upwardly until the tabs 76 extend out of the apertures 43. The insert 70, when placed inside the mechanism 25, is slightly compressed by the spiral guide member 50. In particular, the tabs 76 of the insert 70 are compressed directly and linearly toward one another and the compression force is transmitted to the main body 71 of the insert 70 along planes that are perpendicular to the contact surfaces 77. (Thus, the main body 71 is also slightly compressed.) Due to its flexible nature, the compression causes the insert 70, and in particular the tabs 76, to push back against the compression force. Thus, when the insert 70 is compressed, the contact surfaces 77 are in positive contact with the extension 57. In this manner, the insert 70 provides a means for positively contacting the spiral guide member 50 so as to properly position the spiral guide member 50 in relation to the base 34 along defined, relatively low friction points of contact.

A cup 100 for holding a cosmetic pomade 101 (FIG. 2.) is positioned within the base 34. The cup 100 has a first closed end 102, a second, open end 105, and a cylindrically-shaped bowl 107. The bowl has an interior perimeter 110 (FIG. 4) around which is a plurality of prongs 112 for holding the pomade 101. The cup 100 also has an exterior surface 114 with a means for engaging the slots 46 and 47 and the helically-shaped track 59 in the form of two radially and outwardly extending tabs or protrusions 117. The protrusions 117 fit through the tracks 46 and 47 of the base to engage the helically-shaped track 59.

Operation

The mechanism 25 extends and retracts the cosmetic pomade 101 in a manner similar to known lipstick mechanisms. The base 34 is held stationary and the spiral guide member 50 is rotated causing the cup 100 to move up or down, depending on the direction of rotation. However, the provision of the insert 70 improves the interaction between the base 34 and the spiral guide member 50 because the tabs 76 contact the extension 57 at defined points. Because the insert (or as noted above, just the tabs themselves) is (are) made from low friction material, the friction between the spiral guide member 50 and the base 34 is reduced. The insert 70 is sized, due to its flexible nature, so that the tabs 76 are compressed when the insert 70 is positioned within the mechanism 25. (As noted above, in the preferred embodiment, the inner diameter of the spiral guide member is about 0.62" and the outer diametral dimension of the insert is 0.63".) The sizing and resultant compression cause a positive contact between the contact surfaces 77 and the extension 57 of the spiral guide member 50. This positive contact greatly reduces axial and linear play between the components of the mechanism 25.

While the present invention has been described in what is believed to be the most preferred forms, it is to be understood that the invention is not confined to the particular construction and arrangement of the components herein illustrated and described, but embraces such modified forms thereof as come within the scope of the appended claims.

What is claimed is:

1. A mechanism for extending and retracting a cosmetic pomade, the mechanism comprising:

a base having a first end, a shelf, at least two apertures positioned near the shelf, a middle portion having a plurality of slots, and a second end;

means for holding the cosmetic pomade, wherein said means for holding the cosmetic pomade is positioned within the base and has means for engaging the slots in the base;

a spiral guide member having an outer surface, an inner surface with a track, and a substantially smooth portion, wherein said spiral guide member is positioned coaxially with the base; and a flexible insert positioned within the base and having a main body and at least two radially projecting tabs for engaging the substantially smooth portion of the spiral guide member, each radially projecting tab extending through one of the apertures positioned near the shelf of the base;

wherein the tabs and the main body of the insert are compressed by the substantially smooth portion of the spiral guide member.

2. A mechanism as claimed in claim 1, wherein the tabs on the insert are made from a material having a coefficient of friction of about 0.1 relative to the material of the spiral guide member.

3. A mechanism as claimed in claim 1, wherein the insert is made from a material having a flexural modulus of between about 20 KSI to about 40 KSI.

4. A mechanism as claimed in claim 1, wherein the spiral guide member is made from acrylonitrile butadiene styrene.

5. A mechanism as claimed in claim 1, wherein the means for holding the cosmetic pomade is a cup and said cup contains a lipstick cosmetic.

6. A mechanism for extending and retracting a cosmetic pomade, the mechanism comprising:

a spiral guide member having an outer surface, an inner surface having a helically-shaped track, and a smooth portion;

a base positioned coaxially within the spiral guide member and having a first end, a shelf, a flexible insert for contacting the substantially smooth portion of the spiral guide member, said insert locating the base and the spiral guide member in relation to one another along defined, relatively low friction points of contact and positioned near the shelf, and having a main body that is compressed by the spiral guide member, a middle portion having a plurality of slots, and a second end; and means for holding the cosmetic pomade, wherein said means for holding the cosmetic pomade includes means for engaging the slots in the base and the helically-shaped track.

7. A mechanism as claimed in claim 6, wherein the insert for contacting the substantially smooth portion of the spiral guide member includes at least one radially extending tab.

8. A mechanism as claimed in claim 6, wherein the insert for contacting the substantially smooth portion of the spiral guide member is made from a material having a flexural modulus of between about 20 KSI to about 40 KSI.

9. A mechanism as claimed in claim 6, wherein the spiral guide member is made from acrylonitrile butadiene styrene.

10. A method of extending and retracting a cosmetic pomade within a mechanism, the method comprising:

eliminating play in the mechanism by placing an insert between a base and a spiral guide member of the mechanism, wherein the insert includes a first end, a second end, and two radially extending tabs, each tab having a contact surface, wherein the insert is made out of a flexible material having a flexural modulus of between about 20 KSI to about 40 KSI and a coefficient of friction of about 0.1 relative to the material of the spiral guide member.

11. An insert for use within a mechanism for extending and retracting a cosmetic pomade and having a spiral guide member, the insert comprising:

a first end, a second end, and two radially extending tabs, each tab having a contact surface, wherein the insert is made out of a flexible material having a flexural modulus of between about 20 KSI to about 40 KSI and a coefficient of friction of about 0.1 relative to the material of the spiral guide member.

12. A mechanism for extending and retracting a cosmetic pomade, the mechanism comprising:

a base having a first end with a shelf, at least one aperture positioned near the shelf, a middle portion having a plurality of slots, and a second end;

means for holding the cosmetic pomade, wherein said means is positioned within the base and has means for engaging the slots in the base;

a spiral guide member having an outer surface, an inner surface with a track, and a substantially smooth portion, wherein said spiral guide member is positioned coaxially with the base; and an insert positioned within the base and having at least one radially projecting tab for engaging the substantially smooth portion of the spiral guide member, wherein the at least one radially projecting tab extends through the at least one aperture positioned near the shelf of the base and the insert is made from a material having a flexural modulus of between about 20 KSI to about 40 KSI and a coefficient of friction of about 0.1 relative to the material of the spiral guide member.

13. A mechanism as claimed in claim 12, wherein the insert includes at least two radially extending tabs.

14. A mechanism as claimed in claim 13, wherein the spiral guide member is made from acrylonitrile butadiene styrene.

15. A mechanism as claimed in claim 13, wherein the means for holding the cosmetic pomade is a cup and said cup contains a lipstick cosmetic.

16. In a mechanism for extending and retracting a cosmetic pomade in which means for holding the cosmetic pomade is positioned within a base, and the base has a first end, a shelf, a middle portion having a plurality of slots, and a second end; and the means for holding the cosmetic pomade has means for engaging the slots in the base; and a spiral guide member having an outer surface and an inner surface with a helically-shaped track is positioned coaxially with the base; the improvement comprising:

a substantially smooth extension positioned on the spiral guide member;

two oppositely facing apertures in the base, each aperture positioned near the shelf; and an insert, positioned within the base and having two axially aligned, radially projecting tabs for engaging the substantially smooth portion of the spiral guide member, wherein each radially projecting tab extends through one of the two apertures positioned near the shelf of the base.

17. A mechanism for extending and retracting a cosmetic pomade, the mechanism comprising:

a base having a first end, a shelf, two oppositely facing apertures positioned near the shelf, a middle portion having a plurality of slots, and a second end;

means for holding the cosmetic pomade, wherein said means for holding the cosmetic pomade is positioned within the base and has means for engaging the slots in the base;

a spiral guide member having an outer surface, an inner surface with a track, and a substantially smooth portion, wherein said spiral guide member is positioned coaxially with the base; and an insert positioned within the base and having two opposing and radially projecting tabs for engaging the substantially smooth portion of the spiral guide member, each radially projecting tab extending through one of the two apertures positioned near the shelf of the base;

wherein the tabs and the main body of the insert are compressed by the substantially smooth portion of the spiral guide member.

* * * * *